United States Patent [19]

Gallusser et al.

[11] 4,361,373

[45] Nov. 30, 1982

[54] ELECTRICAL CONNECTOR COMPRISED OF PLASTIC

[75] Inventors: David O. Gallusser, Oneonta; Valentine J. Hemmer, Sidney; Gary C. Toombs, Oneonta, all of N.Y.

[73] Assignee: The Bendix Corporation, Southfield, Mich.

[21] Appl. No.: 206,794

[22] Filed: Nov. 14, 1980

[51] Int. Cl.[3] ..... H01R 13/639

[52] U.S. Cl. ..... 339/89 M; 339/DIG. 2

[58] Field of Search ..... 285/82, 86; 339/89 R, 339/89 C, 89 M, 90 R, 90 C, DIG. 2

[56] References Cited

U.S. PATENT DOCUMENTS

| | | | |
|---|---|---|---|
| 3,066,272 | 11/1962 | Quackenbush | 339/89 |
| 3,445,805 | 5/1969 | McLoad | 339/89 R |
| 3,552,777 | 1/1971 | Heinrich et al. | 339/DIG. 2 |
| 3,594,700 | 7/1971 | Nava et al. | 339/89 R |
| 3,805,379 | 4/1974 | Vetter | 29/629 |
| 3,808,580 | 4/1974 | Johnson | 339/89 R |
| 3,917,373 | 11/1975 | Peterson | 339/89 R |
| 4,074,927 | 2/1978 | Ball | 339/89 M |
| 4,322,121 | 3/1982 | Riches et al. | 339/89 M |

*Primary Examiner*—John McQuade
*Attorney, Agent, or Firm*—Raymond J. Eifler

[57] ABSTRACT

The invention is a plastic connector assembly characterized by a metal washer **10*b*, located between a wave washer 30 and the shoulder 21 of the connector housing 20. The metal washer 10 is further characterized by at least one projection 11 or 12 thereon which prevents relative motion between the metal washer 10*b* and the housing shoulder 21. This reduces the wear on the shoulder of the housing. Similarly to reduce wear on the shoulder in the coupling ring a second metal washer 10*a* may be placed on the other side of the wave washer 30** to accomplish the same purpose.

5 Claims, 5 Drawing Figures

FIG.3 FIG.2
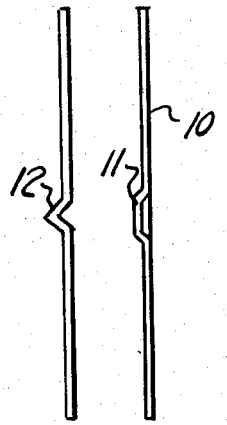
FIG.1
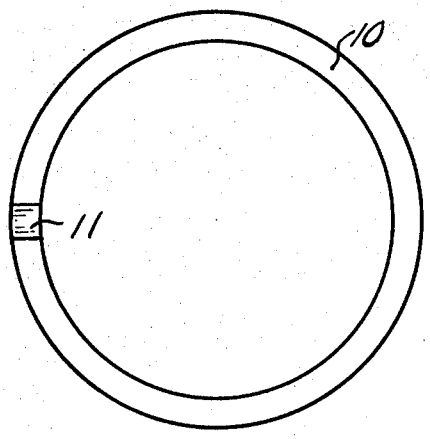
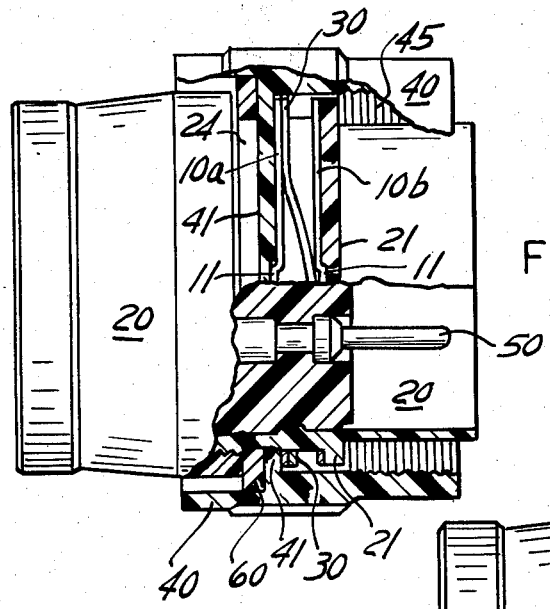
FIG.4
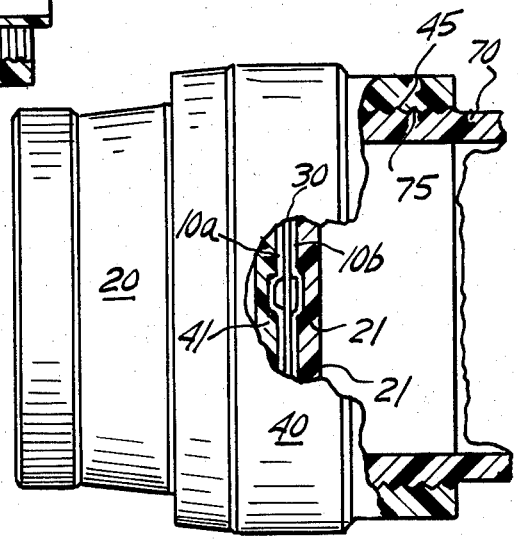
FIG.5

ELECTRICAL CONNECTOR COMPRISED OF PLASTIC

This invention relates to the mounting of a coupling ring to a plastic connector assembly.

An electrical connector assembly is generally comprised of two separate housings, each having contacts mateable with contacts in the other when the housings are connected together by a coupling member. A coupling member is generally mounted to one of the housings by one or more snap rings to captivate a flange of the coupling ring against the shoulder of the housing. In one type of coupling ring, threads in the forward portion are adapted to engage threads on another housing to connect the housings together. To prevent unwanted decoupling of the connector housing, the coupling member is usually biased in one direction (rearwardly) to increase the frictional force on the threads when the coupling member is completely threaded onto the other housing. Generally, a spring in the shape of a wave washer is used in the coupling ring mounting assembly to provide the necessary bias. Examples of such a connector assembly may be found in U.S. Pat. Nos. 4,074,927, issued Feb. 21, 1978 and entitled "Electrical Connector with Insert Member Retaining Means"; and 3,805,379, issued Apr. 23, 1974 and entitled "Method of Assembling an Electrical Connector to Affect a Preloading Thereof". When a connector housing or coupling nut is comprised of plastic, there is a great deal of friction and hence wear between a surface of the coupling nut and the flange on a housing to which the coupling nut is mounted. This occurs during the mating process as the wave washer becomes compressed to provide the rearward bias against the coupling nut. When the wave washer compresses it also moves relative to the flange on the plastic housing wearing down the flange.

DISCLOSURE OF THE INVENTION

This invention reduces the wear that the coupling nut or housing shoulder would normally be subjected to in a plastic connector.

The invention is a plastic connector assembly characterized by a metal washer, located in a coupling nut mounting mechanism, that bears against the surface of a wave washer. The metal washer is further characterized by at least one projection thereon which prevents relative motion between the metal washer and the housing shoulder. To reduce wear on the shoulder of the coupling ring a second metal washer may be placed on the other side of the wave washer to accomplish the same purpose.

One advantage of this invention is that it eliminates any wear of the plastic shoulders of the housing or coupling ring.

DETAILED DESCRIPTION OF THE INVENTION

FIG. 1 is an end view of a metal washer.

FIG. 2 is a side view of the metal washer shown in FIG. 1.

FIG. 3 is a side view of an alternate to the washers shown in FIGS. 1 and 2.

FIG. 4 illustrates electrical connector embodying the principles of the invention.

FIG. 5 is another view of a connector assembly embodying the principles of this invention.

Referring now to the drawings, FIG. 1 illustrates a metal washer 10 which may be comprised of a suitable material such as beryllium copper. The washer 10 includes at least one projection 11 extending from one of the flat surfaces of the washer.

FIG. 2 illustrates one shape of the projection 11 extending from the washer 10.

FIG. 3 illustrates another shape for a projection 12 from the washer 10. Here, at least one sharp projection 12 extends from one of the flat surfaces of the washer 10. Alternately there could be a plurality of sharp projections 12.

FIG. 4 illustrates an electrical connector assembly which includes a plastic housing 20 having a plurality of contacts 50 mounted therein and an annular groove 24 around the outside of the housing 20; and coupling ring 40 mounted to the housing 20. The coupling ring 40 is mounted to the housing 20 by a snap ring 60 which captivates an internal annular shoulder 41 of the coupling ring between the snap ring 60 and an annular shoulder 21 which extends outwardly from the housing 20. The forward portion inside the coupling ring includes threads 45 for connecting the coupling ring to another housing (not shown). To provide a rearward bias on the coupling ring 40 there is a wave washer 30 which may be comprised of plastic or metal and which can be compressed axially to provide a rearward force against the coupling ring 40. In the embodiment of the invention there is a metal washer **10*a* and 10*b* on both sides of the wave washer 30. The washer 10*b* is mounted against shoulder 21 of the housing 20 and relative rotation of the washer 10*b* and the housing shoulder 21 is prevented because of the projection 11 which extends into a recess in the shoulder 21. Relative motion of the washer 10*a* with the coupling ring shoulder 41 is similarly prevented by the projection 11 which extends into a recess in the shoulder 41 of the coupling ring 40. It is understood that the shoulders of both the housing 20 and the coupling ring 40 could have a plurality of recesses. Further, that if the washer shown in FIG. 3 was used, no recesses would be required as the sharp projection 12** on that type of washer would be sufficient to prevent relative movement of the washer with the surfaces which it engages.

FIG. 5 illustrates how the housing 20 is connected to a similar housing 70 of the other half of the connector assembled by the coupling ring 40. The cutaway view illustrates how the threads 45 of the coupling ring are completely threaded to the threads 75 on the other housing 70. This compresses the wave washer 30 to provide a rearward bias in the coupling ring 40 which increases the frictional force between the threads on the coupling ring 40 and the housing 70.

While a preferred embodiment of the invention has been disclosed, it will be apparent to those skilled in the art, that changes may be made to the invention as set forth in the appended claims, in some instances certain features of the invention may be used to advantage without corresponding use of other features. Accordingly, it is intended that the illustrative and descriptive materials herein be used to illustrate the principles of the invention and not to limit the scope thereof.

Having described the invention what is claimed is:

1. In combination with an electrical connector of the type having: a cylindrical housing comprised of plastic and having a central axis, a forward portion, a central portion, a rear portion, an annular groove in said central portion, and an annular shoulder spaced forwardly of said groove; a plurality of electrical contacts mounted in said housing, each of said contacts having a forwardly facing mating portion; a coupling ring telescoped over a portion of said housing, said coupling ring having a rear portion and a forward portion adapted to connect to a similar housing having contacts that are adapted to mate with said contacts in said housing, the rear portion of said coupling ring having an inwardly extending annular flange that includes a forward face and a rear face; and means for rotatably mounting said coupling ring to said housing between the groove and the shoulder of said housing, the improvement wherein said mounting means comprises;

a snap ring located in the groove in said housing, one side of said snap ring abutting the rear face of said coupling ring flange;

a wave washer located between the forward face of said coupling ring flange and the shoulder of said housing;

a metal washer positioned against the rear face of said housing shoulder; and means for preventing relative movement between the metal washer and the shoulder of the plastic housing, said means including at least one axial projection on said metal washer extending towards the rear face of said housing shoulder to fixedly position the washer against the rear face.

2. The electrical connector as recited in claim 1 wherein said wave washer is comprised of plastic.

3. The electrical connector as recited in claims 1, or 2 including a second metal washer located between the wave washer and the forward face of said coupling ring flange, and means for preventing relative motion between said second metal washer and said coupling ring, said means including at least one axial projection on said second washer extending towards the forward face of said coupling ring flange.

4. The electrical connector as recited in claim 1 wherein the means for preventing relative movement between the metal washer and the housing shoulder further includes at least one recess in said housing shoulder for receiving the projection on said metal washer.

5. The electrical connector as recited in claim 3 wherein the means for preventing relative movement between the second metal washer and the forward face of said coupling ring flange further includes at least one recess in said coupling ring flange for receiving the projection on said second metal washer.

* * * * *